US006209865B1

(12) United States Patent
Regimbal et al.

(10) Patent No.: US 6,209,865 B1
(45) Date of Patent: Apr. 3, 2001

(54) METHOD AND APPARATUS FOR IMPROVED STACKING QUALITY IN A DEVICE THAT EFFECTS ONE OR MORE OF MEDIA TO AN OUTPUT STORAGE LOCATION

(75) Inventors: Laurent A. Regimbal, Eagle, ID (US); Hernan Gutierrez; Rual Ocampo, both of Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/480,538

(22) Filed: Jan. 10, 2000

(51) Int. Cl.[7] ..... B65H 31/26

(52) U.S. Cl. ..... 271/220; 414/789.9; 414/790.3; 414/791.2

(58) Field of Search ..... 271/220, 218, 271/213; 414/789.9, 790.3, 790.2, 791.2

(56) References Cited

U.S. PATENT DOCUMENTS

| | | | |
|---|---|---|---|
| 4,318,541 | 3/1982 | Nagel et al. | 271/222 |
| 4,319,743 | 3/1982 | Rood | 271/184 |
| 4,325,544 | 4/1982 | Magno et al. | 271/221 |
| 4,325,545 | 4/1982 | Fabrig | 271/221 |
| 4,354,672 | 10/1982 | Kulpa et al. | 271/221 |
| 4,501,418 | 2/1985 | Ariga et al. | 271/187 |
| 4,508,333 | 4/1985 | Byrt | 271/218 |
| 4,548,399 | 10/1985 | Heider et al. | 271/221 |
| 4,616,821 | 10/1986 | Boeve et al. | 271/213 |
| 4,650,178 | 3/1987 | Steele et al. | 271/305 |
| 4,657,239 | 4/1987 | Ikesue et al. | 271/227 |
| 4,776,578 | 10/1988 | Hirakawa et al. | 271/223 |
| 4,890,825 | 1/1990 | McCormick et al. | 271/188 |
| 4,981,293 | 1/1991 | Yamashita et al. | 271/184 |
| 4,986,730 | 1/1991 | Wetter | 414/792.7 |
| 5,014,091 | 5/1991 | Koike et al. | 355/321 |
| 5,026,034 * | 6/1991 | Russel et al. | 271/220 |
| 5,054,764 | 10/1991 | Phillips et al. | 271/189 |
| 5,139,254 | 8/1992 | Yamashita et al. | 271/215 |
| 5,215,303 | 6/1993 | Yamada et al. | 271/240 |
| 5,236,189 | 8/1993 | Ikoma | 271/292 |
| 5,393,042 | 2/1995 | Coombs et al. | 270/53 |
| 5,695,186 | 12/1997 | Phillips et al. | 271/252 |
| 5,713,566 | 2/1998 | Coombs et al. | 270/58.12 |

* cited by examiner

*Primary Examiner*—David H. Bollinger

(57) ABSTRACT

In a device that ejects one or more sheets of media to a moveable, remote output storage location, a method and apparatus for improving output stack quality is described. An invented stack holder holds previously-ejected sheets in place, so that the ejection of a newly-accumulated job does not cause misalignment of the stack by pushing the paper that it contacts during its movement. The preferred stack holder(s) each have an arm that extends down from a part of an accumulator and have a friction pad or area near its end. The system logic causes the stack tray to move up until the top of the output stack is sensed to be at a location that means it is abutting against the stack holder(s). In this position, the stack holder(s) place enough downward pressure on the top sheets of the output stack to hold the top sheets in place while an accumulated job is rejected onto the output stack. The stack tray logic then moves the tray down away from the stack holder at the appropriate time at the end of the ejection of the accumulated job, so that the stack tray and its stack do not touch the stack holders and, hence, do not interfere with operation of the accumulator. Simultaneously or immediately after the stack tray moves downward, the accumulators off-setters return to their home position to move the stack holders laterally away from the stacked and ejected media and to complete the end of ejection of an accumulated job.

17 Claims, 6 Drawing Sheets

METHOD AND APPARATUS FOR IMPROVED STACKING QUALITY IN A DEVICE THAT EFFECTS ONE OR MORE OF MEDIA TO AN OUTPUT STORAGE LOCATION

FIELD OF THE INVENTION

This invention generally relates to print media handling and storage devices for printing, copying, or multiple-function document devices. More specifically, the invention relates to apparatus and method for improving the quality of media stacking, so that the resulting output stack is uniform and does not have displaced sheets.

BACKGROUND OF THE INVENTION

An important criteria for customer satisfaction regarding a printing, copying, or multiple-function document device is the quality of stacking of the paper or other media that is output to a temporary or permanent storage location. For example, a laser printer provided with a remote output stacking unit may be operated to produce large stacks of multiple jobs, for example, wherein the jobs represent the same document printed out many times in succession, whether the document/job is a single sheet or many sheets. Such a stacking unit typically stacks the multiple jobs in a single stack, with the jobs contacting each other without any separating members or trays between the jobs as might be present between multiple copies in a photocopier sorter. The stacking unit may include means for allowing easy separation of the jobs, which may be conventional apparatus and logic to stack each job at a position slightly offset laterally from the previous job, that is, staggering the positions of alternating jobs a fraction of an inch to each side. Examples of conventional stacking technology, both for sheet alignment and lateral job offset, may be seen in several U.S. Pat. Nos.: 4,318,541 (Nagel et al.), 4,319,743 (Rood), 4,319,744 (Nagel et al.), 4,325,544, (Magno et al.), 4,325,545 (Fabrig), 4,354,672 (Kulpa et al.), 4,508,333 (Byrt), 4,548,399 (Heider et al.), 4,616,821 (Boeve et al.), 4,650,178 (Steele et al.), 4,657,239, (Ikesue et al.), 4,776,578 (Hirakawa et al.), 4,981,293 (Yamashita et al.), 4,986,730 (Wetter), 5,014,091 (Koike et al.), 5,054,764 (Phillips et al.), and 5,713,566 (Coombs et al.).

Stacker units of particular interest for implementation of the present invention are the type included on the 8000 Series LaserJet™ printers made by Hewlett Packard. Such a printer has a media output path that discharges paper or other media from the printer engine, with the paper edges being herein defined as a leading edge (first exiting the output path), the trailing edge (last exiting the output path), and two side edges of the paper which run transverse to the leading edge and trailing edge. The output path includes a device called an accumulator, which is typically external to the print engine housing and may be considered part of the stacking unit. The single sheet or plurality of sheets of an individual job being discharged are temporarily stored in the accumulator before being post-processed, if requested, and delivered to the final output destination. The accumulator comprises a floor, moveable sideguides with paper supports ("off-setters"), a fixed lower set of rollers, and a moveable set of upper rollers 51 that are used to align, and ultimately, to move the job. The off-setters of the accumulator contact and catch the two side edges of the accumulated sheets, and the floor of the accumulator supports the center region of the accumulated sheets. The successive sheets discharged into the accumulator 20 are inherently aligned with the other sheets in the accumulator. After a job is completed, that is, discharged in its entirely into the accumulator, the job is transported to the post-processing device, if requested. Then, the completed job is ejected by the accumulator onto a moveable stack tray disposed in front of and underneath the accumulator. The accumulator ejects the job, for example, by actuating a push-bar as in shown in the drawings, or by other systems, such as upper moveable rollers closing against lower fixed rollers and "pushing" the job to the "output bin." The output bin comprises the stack tray with any previous jobs that are stacked on top of the stack tray. Thus, if a job or jobs have been previously ejected onto the stack, tray, the current job is actually ejected onto the top of the previous job that, in turn, may be on top of prior jobs that rest on the stack tray. Prior to ejecting the current job onto the previous job, the off-setters of the accumulator are actuated, as determined by the logic of the system, to push the accumulated job to one side a predetermined amount of typically less than one inch before the job if ejected onto the stack. This way the various jobs are staggered or "offset" so that a first side edge of alternate jobs stick out laterally relative to the jobs above and below enough for a user to grasp and separate the jobs.

Typically, conventional media stacking technology results in misaligned sheets in some or all of the jobs, because there are no forward limits to control forward misalignment of sheets. The frequency of misaligned sheets may vary and may depend, for example, on the particular design of the stacking unit, maintenance of the stacking unit, paper quality, and ambient conditions such as humidity. The inventors believe that the majority of the stack misalignment is due to the force produced by ejecting the current job against the top sheets of the pre-existing stack as the current job slides forward and down from the accumulator to lie on the pre-existing stack. The ejected job slides against the output stack and displaces the top sheet or sheets from one to several inches, depending on the number of pages in the print job as well as the size and type of paper being printed.

Many stacking units, therefore, produce a misaligned stack that requires intermediate processing of many of the jobs prior to stapling, hole-punching, or binding. This intermediate processing involves separating the jobs and then straightening each misaligned job by pushing, tapping, or re-stacking the displaced sheets to align them with the rest of that job's sheets. This intermediate handling is time-consuming and frustrating for users, and adds significantly to the cost of document or booklet production.

Mechanisms have been added to some stacking units in attempts to correct the misalignment problem. For example, a rotating fingers mechanism has been added to the output device used with the Xerox Finisher for Xerox N32 and N40 printers, in such a way that the fingers hold down the top sheet in the output stack while the next job is ejected on the top of the output stack. After the job has been ejected, the fingers rotate out from under the ejected job and come to rest on top of the stack once again. The rotating finger mechanism has the disadvantage of requiring an additional, specialized mechanism to the accumulator/stacking unit, which increases costs and maintenance.

Therefore, an improved stacker is still needed, to reduce or eliminate manual processing of printed/copied jobs to correct displaced sheets. Still, there is a need for an economical, reliable solution to the displacement problem, whether the ejected jobs are a single sheet or multiple sheets, and the present invention addresses this need.

SUMMARY OF THE INVENTION

The present invention comprises a method and apparatus for improving stacking quality in a device that ejects one or more sheets of media to a moveable, remote output storage location. The invention apparatus and method result in a stack that is ready for post-processing, such as hole-punching or binding, without the intermediate operation of straightening the sheets of a stack or stack portion before the post-processing.

The present invention comprises a stack holder that extends down from the accumulator of a stacking unit, preferably down from the moveable side-guides or "offsetters," to contact the stack already in place on a stack tray (also, "the previous job"). The invented stack holder holds the top sheets of the stack in place while media sheet(s) are being ejected ("the current job") from the accumulator onto the stack. The stack holder preferably comprises a member having a frictionally-engaging pad at the position on the member that is adapted to contact the top sheet of the stack during ejection of the current job. The pad comprises a material or surface adapted to grip the media in the stack and prevent movement of the media relative to the pad, and, therefore, movement of the media relative to rest of the output stack. In this way, the media of the pre-existing stack is held in place while the current job sheet(s) are being ejected from the accumulator, and, when the current job sheets slide onto the stack, the current job sheets may not push the pre-existing stack sheets forward out of alignment.

The preferred method and apparatus provides for the stack tray to be moveable up and down relative to the printer/output device housing and, specifically, relative to the accumulator. The stacker logic automatically moves the stack tray during various steps of the printing and stacking process, to cooperate with the stack holder(s) that are attached preferably to the bottom of the off-setters of the accumulator. Specifically, the stack tray moves up near the accumulator just prior to and during the ejection of an accumulated job onto the stack, so that the stack holder(s) contact and hold the top of the stack in the stack tray. Once the job has been successfully ejected, the stack tray moves down away from the accumulator. In this way, neither the stack tray nor the stack of papers on the tray interfere with the stack holders (or, hence, the accumulator) while the next job is being accumulated.

Preferably, each stack holder is a generally stationary member with a frictional surface, and does not require any moving parts, actuators, or active mechanisms, except for the cooperation of the stack holder and the moving stack tray and its operation logic. The preferred stack improvement method includes providing a stack holder at an appropriate position and angle so that it does not contact the stack during accumulation of a current job, whether it be the first accumulated job or a later job of many that are being stacked. The stack holder is also positioned so that, when the stack tray moves upward near the accumulator, the top of the stack comes in contact with the stack holder with enough force for the stack holder to grip the top sheet and apply enough downward pressure on the stack that several of the upper sheets of the stack are held in place relative to each other. Thus, while the stack holder presses on the stack, the accumulator ejects the current job onto the stack without the bottom sheet(s) of the current job being able to push the stack's upper sheets out of alignment.

DETAILED DESCRIPTION OF THE INVENTION

Figure 1:
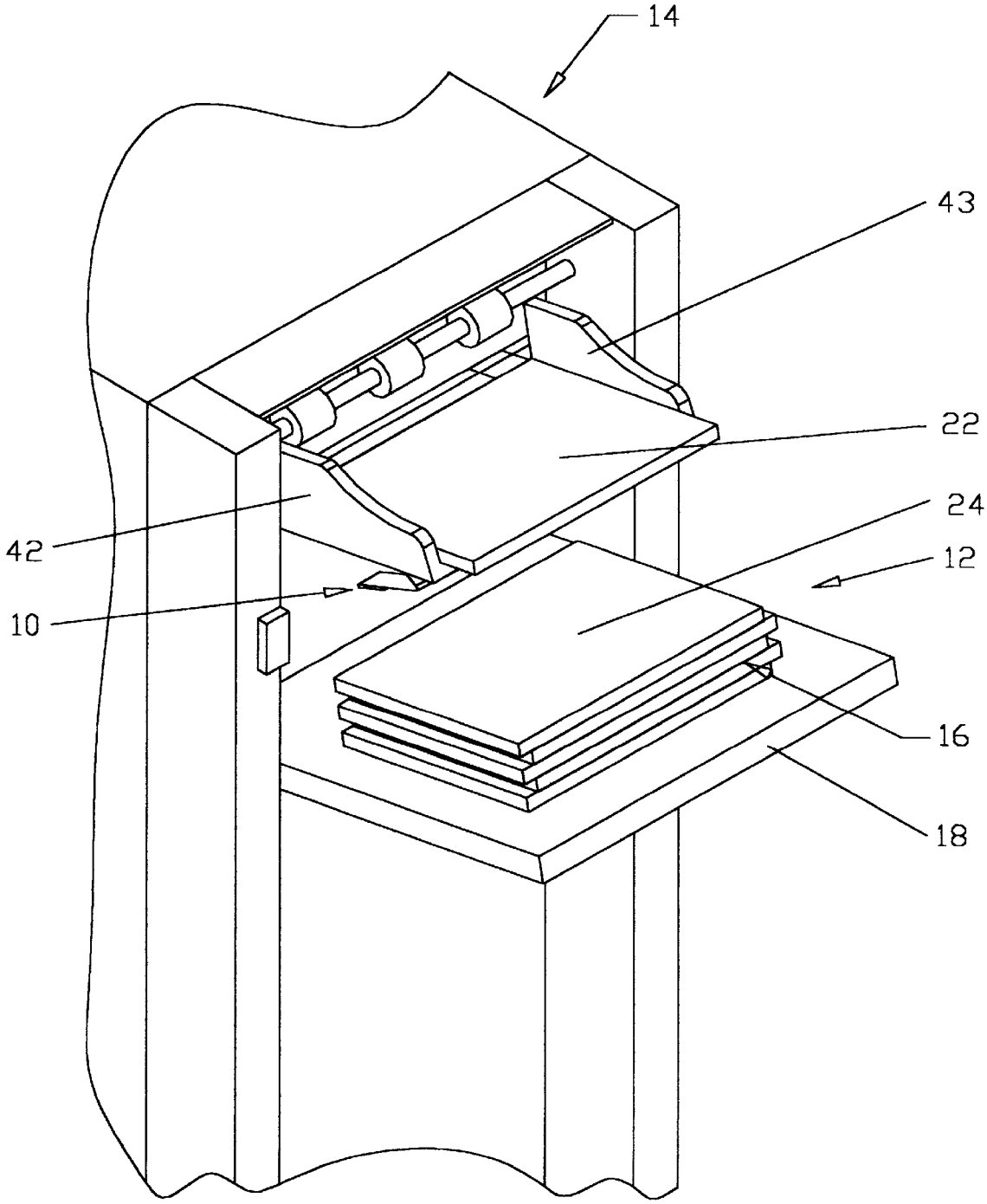
FIG. 1 is a schematic side perspective view of one embodiment of the invented stack holder installed on one embodiment of a stacking unit of a large-volume printer or printer/copier, with the stack lowered away from the stack holder and the accumulator.

Referring to the Figures, there is shown one, but not the only, embodiment of the invented stack holder 10 for a stacking unit 12 of a large volume document printer/copier/multi-purpose device 14. The Figures also illustrate steps of the invented method for creating and maintaining an aligned output stack 16. The invented stack holder 10 and method reduce or eliminate the problem of sheet misalignment in an output stack 16, which is discussed in the Background of the Invention section above. The invented stack holder 10 is used to hold down the top sheet(s) 24 of the stack each time an accumulated job 22 moves forward onto the stack 16, so that the top sheet(s) 24 are not frictionally gripped and moved forward by the moving job 22.

Figure 2:
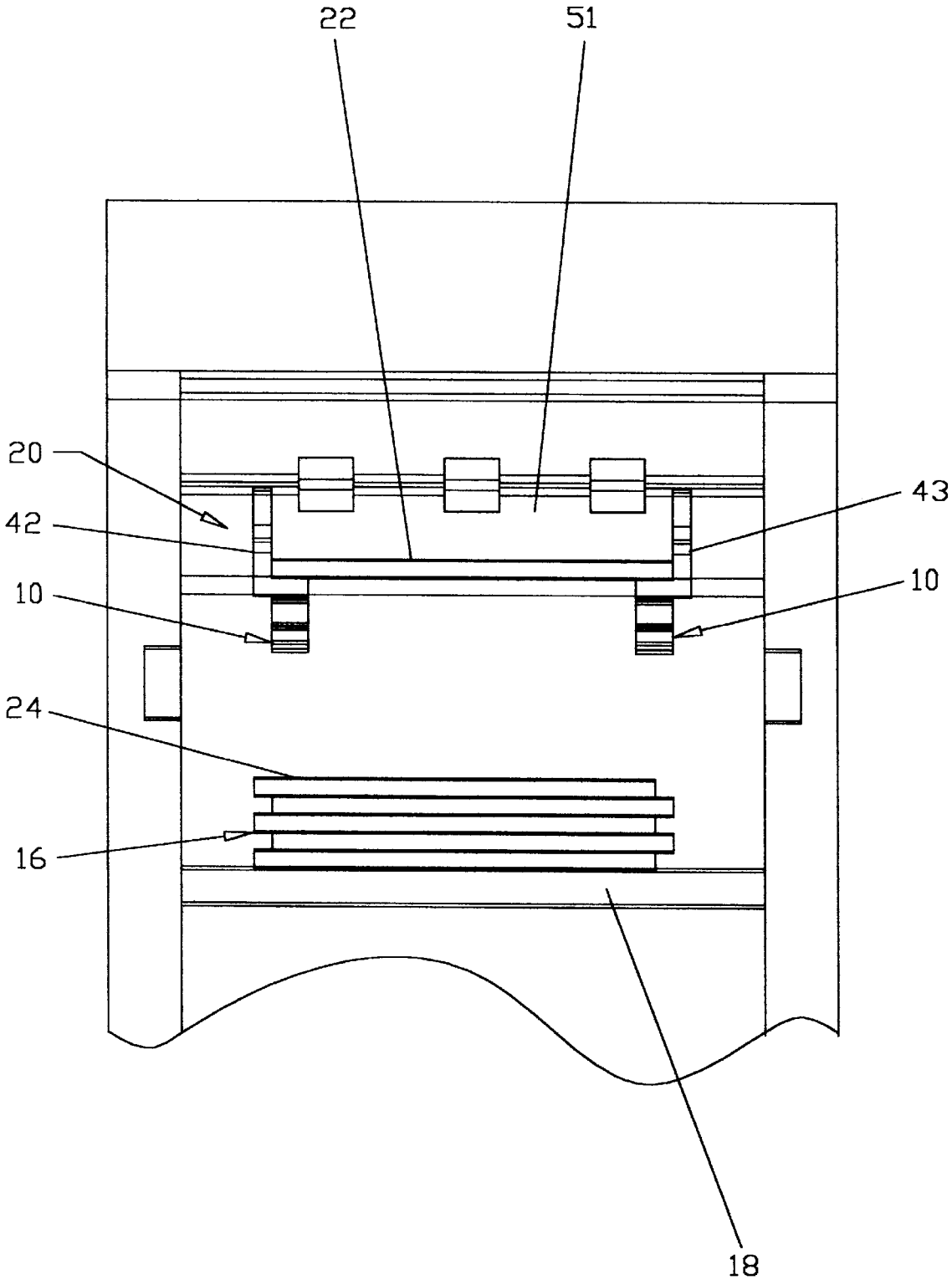
FIG. 2 is a schematic front perspective view of the stack holder and stacking unit embodiments of FIG. 1, shown with the stack being raised towards the stack holders.
Figure 3:
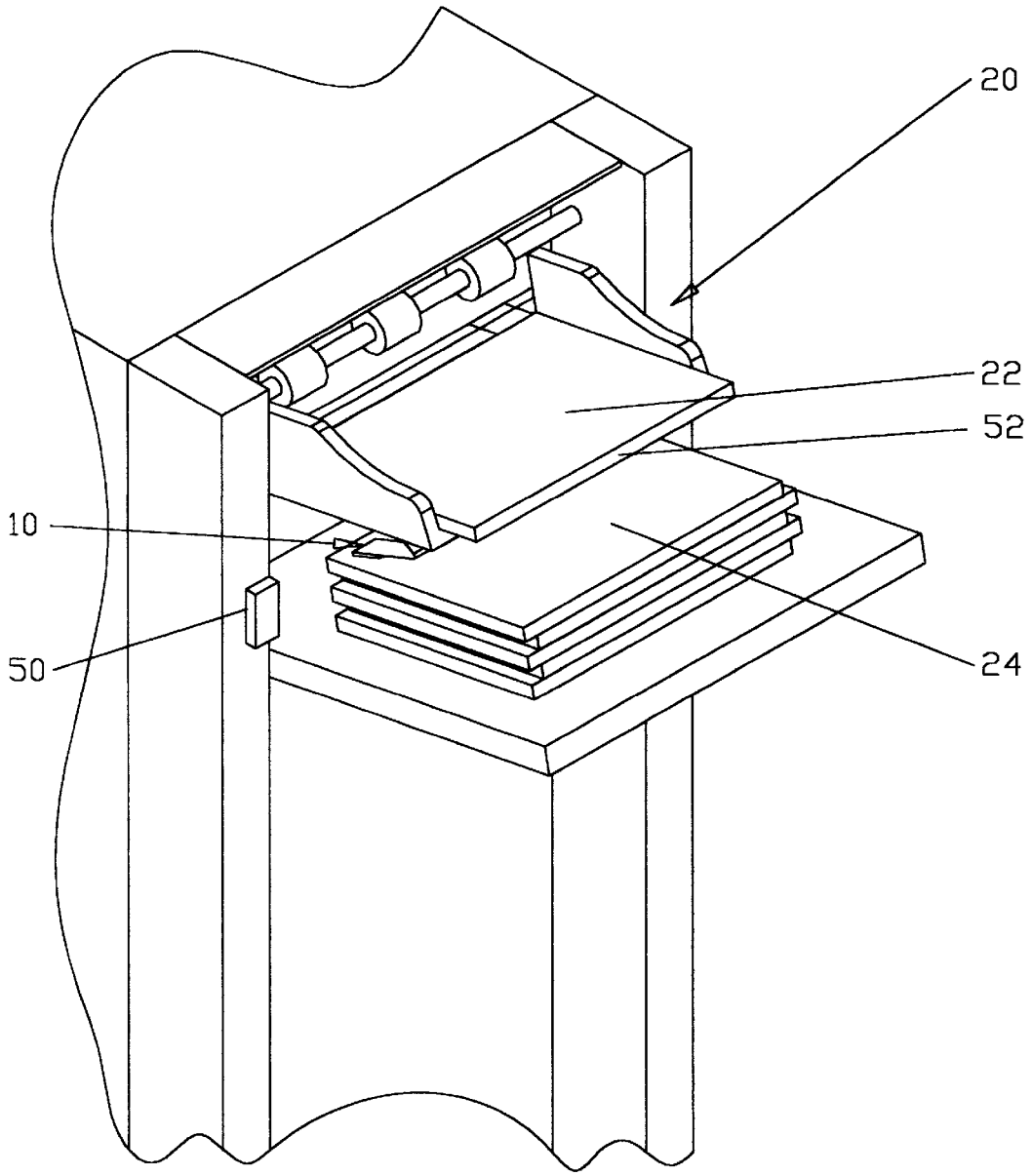
FIG. 3 is a schematic side perspective view of the stack holder and stacking unit embodiments of FIGS. 1 and 2, shown with the stack raised into contact with the stack holder while the job in the accumulator above the stack holder is being ejected.
Figure 4:
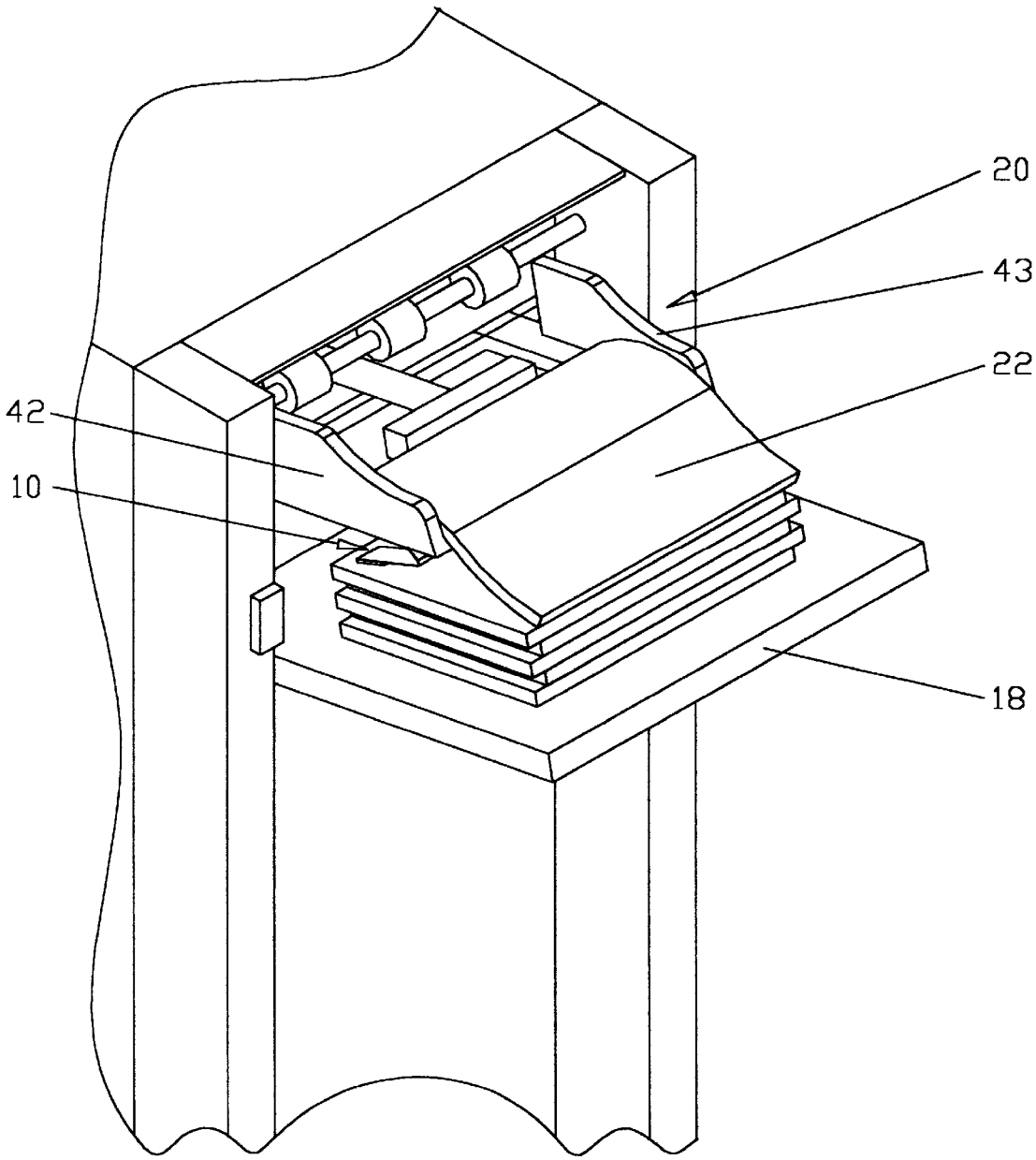
FIG. 4 is a schematic side perspective view of the stack holder and stacking unit embodiments of FIGS. 1–3, with the job in the accumulator nearly fully-ejected.
Figure 5:
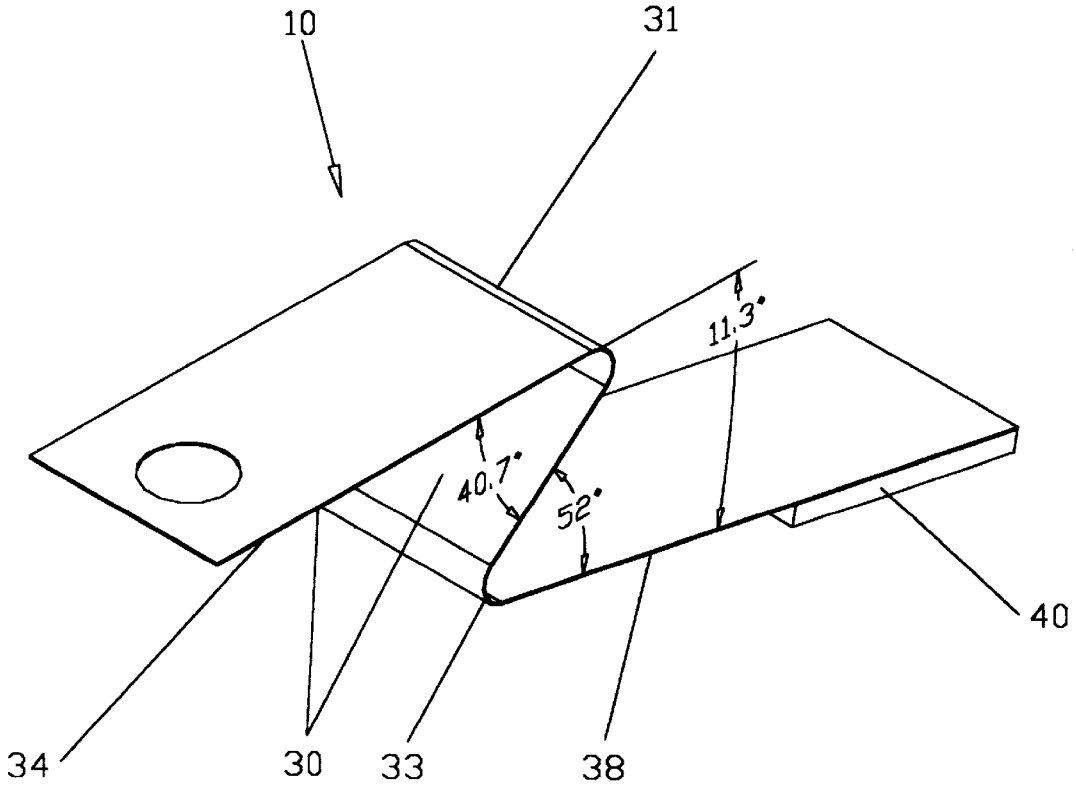
FIG. 5 is a perspective side view of the stack holder embodiment of FIGS. 1–4, detached from the stacking unit.
Figure 6:
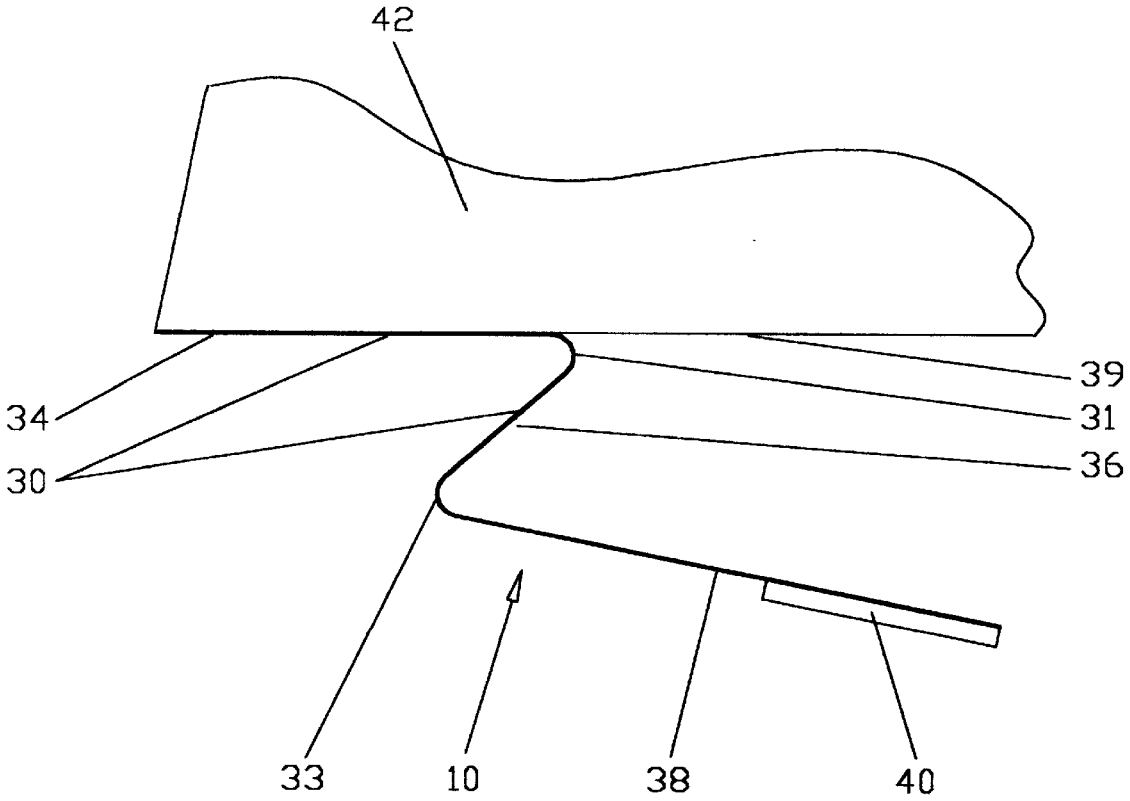
FIG. 6 is a side view of the stack holder of FIG. 5, connected to the bottom surface of an accumulator off-setter, and shown with a frictionally-engaging pad at one end of the stack holder.
Figure 7:
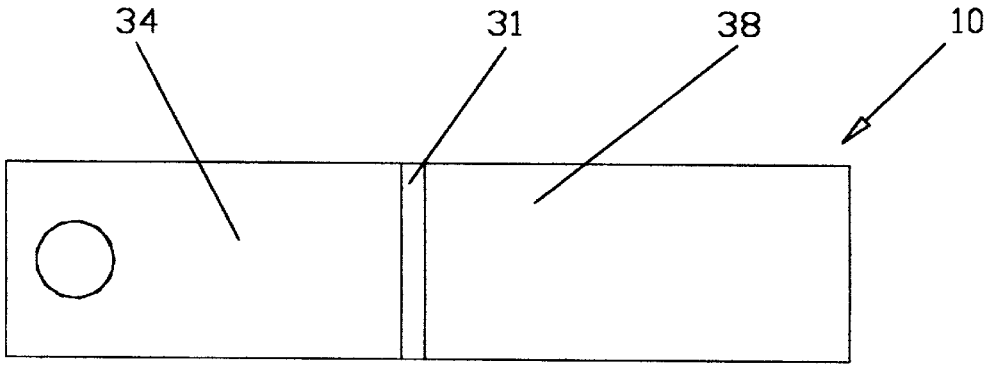
FIG. 7 is a top view of the stack holder of FIGS. 5 and 6.

The preferred method of using the stack holder 10 is illustrated in FIG. 1 wherein the stack holder 10 is not contacting the stack 16 during offsetting and accumulation; in FIG. 2 wherein the stack tray 18 is being raised toward the accumulator 20 and its stack holders 10; and in FIGS. 3 and 4 wherein the stack holders 10 are contacting the stack 16 during ejection of an accumulated job 22 to prevent forward movement of stacked sheets into a misaligned position. FIGS. 5–7 show details of one embodiment of the invented stack holder 10, while the inventors also envision other geometries for stack holder arms that would work well.

The stack holder 10 comprises a downwardly-protruding arm or other member that comes in contact with the stack 16 when the stack 1 6 is within a few inches of the accumulator 20. As illustrated in FIGS. 5–7, the preferred stack holder 10 comprises an elongated strip 30 that is bent at a first bend 31 and a second bend 33 along its mid-section. The two bends 31, 33 form the strip 30 into generally a Z-shape, with an end first portion 34 for attachment to the accumulator 20, a middle second portion 36, and an opposing end third portion 38 for contacting the output stack 16. The first portion 34 is preferably connected to the bottom surface 39 of the accumulator by fasteners such as bolts, rivets, welding, or other connection means. Preferably, two stack holders 10 are preferably fastened or integral to each of the two off-setters of the accumulator, also called the left and right side-guides or "wings" 42, 43, respectively. Preferably, the first portion 34 of each stack holder 10 is fixedly and non-rotatably attached to a wing 42, 43.

The angles of the bends 31, 33 and the length of the strip 30 are chosen to position the third portion 38, and particularly its friction pad 40, at an effective position about 2 inches below the accumulator 20, and approximately about 4–6 inches forward from the vertical plane of the rear edges 45 of the stack 16. Preferably, the bends 31, 33 are curved at about a 2 mm radius. The preferred bends 31, 33 are 40.7 degrees and 52 degrees, respectively, and place the third portion 38 at an angle of about 10–12 degrees to the first portion 34. In the preferred embodiment, the first portion 34 is positioned on the bottom surface 39 at about 20–30 degrees, which serves to position the third portion 38 at an angle of about 30–40 degrees from horizontal. Thus, the third portion 38 extends forward across about the rear ⅓ of the stack and the pad 40 "hangs" at about 30–40 degrees from horizontal over the stack 16. Other angles and positions may be effective, and the angles and lengths of the portions of the strip should be chosen to cooperate with various angles of offsetters and stacking tray. The preferred criteria is to have the pad of the stack holder contact the stack and deform about 5 mm to put pressure on the top sheets of the stack.

Friction pad 40 is attached to the third portion 38 and is preferably made of a durable material that grips the top sheets 24 of the stack 16 sufficiently to prevent their forward movement but does not stick to the sheets 24, or mar, mark, or significantly abrade the sheets. Rubber, polyurethane, or other materials may be used for friction pad 40, as long as the pad has an outer surface that is rough enough to frictionally engage the top sheet of the output stack. The pad 40 is preferably attached to the strip 30 by means of an adhesive.

Strip 30 is preferably made of spring steel, or other flexible material. Flexibility and resilience is desired in the strip 30 material, so that the strip will flex slightly when the stack 1 6 moves up against it to place appropriate force on the top sheets 24 and so that the strip 30 will return to its original position. Preferably, the strip 30 is a simple, single unitary strip of material featuring the desired flexibility, resilience, and durability for repeated use.

Preferably, two stack holders 10 are installed, one beneath the left wing 42 of the accumulator, and one beneath the right wing 43 of the accumulator. In the preferred embodiment, the wings 42, 43 are typically positioned, during accumulation and therefore also when the stack tray moves up for ejection, so that only one stack holder contacts the stack during ejection. This way, whichever side the laterally offset wings are on, one stack holder is positioned directly over at least a part of the stack. The large frictional pad 40 of the one contacting stack holder contacts enough surface area of the top of the stack to hold the top sheets in place, and there is little or no tendency of the sheets 24 to twist/swing forward. In this way, a stack holder 10 contacts the top sheets 24 on the output stack both near either the right side edge 46 of the sheets or the left side edge 47 of the sheets. Alternatively, other embodiments may include accumulator systems in which more than one stack holder contacts the stack each time a job is ejected.

The stacking tray 18 is generally at an angle of 15–25° from horizontal and travels up and down in vertical tracks in the side of the device 14, powered by a tray motor (not shown). Position sensor(s) 50 are included on the device to respond to the position of the tray 18 as discussed below.

In use, the current job, also called the "accumulated job" 22 is collected in the wings 42, 43 of the accumulator, while the stacking tray 1 8 is in the lowered position with the stack holder 10 typically several inches above the top of the stack 1 6. When the device's control logic is about to eject the current job 22 from the accumulator, the stacking tray motor is activated and moves the stacking tray upwards, until the tray full sensor (TRFU) 50 senses the position of the top of the stack 1 6, which means the top of the stack is a known distance from the bottom of the accumulator. Then, the logic interrupts the electrical current to the tray motor and stops the tray 1 8. At this point in time, due to the position of the invented stack holders 10, the stack is also abutting up against the pads 40 of the stack holders. The pressure of the stack holder pads 40 against the top sheets 24, causes the top sheets 24 to be held down in their aligned position.

To eject the accumulated job, the eject motor (not shown) begins to push the current job 22 forward out of the accumulator 20. This ejection may be done by various means, for example, a push-bar system as is shown in the drawings, a moveable roller system, or other mechanisms for moving a job forward out of the accumulator. As the current job 22 moves forward and the front portion 52 of the job curves downward in front of the wings 42, 43, the bottom surface of the front portion 52 (normally, the bottom surface of the bottom sheet of the current job 22) slides forward along the front portion of the top sheets 24. Because of the force of the stack holders on the top sheets 24, however, the sheets 24 do not move forward into misalignment. When the current job 22 is substantially out of the accumulator, about the front ⅔ of the current job is resting on the previous job on the stack, and the rear ⅓ of the current job is resting in the accumulator wings. At this point, the ejection motor is still on, and the tray motor is activated to lower the stacking tray 18. As the stacking tray 18 lowers, the stack 16 moves down away from and out of contact with the stack holder. At this time, the current job 22 is already in its most-forward position and will not thereafter move a significant distance horizontally forward, and the stack holder 10 is no longer needed to hold the stack top sheets. The offset pushers are then moved horizontally out apart to their home positions, and this allows the rear edge of current job 22 to fall onto the stack 16. In this way, the stack holder(s) are moved horizontally away from the current job and do not touch and are never beneath the ejected job.

The capacity of the tray 18 is preferably in the range of 2000 to 5000 sheets of paper. Because of the greatly varying weights of loads on the tray 18 during operation, depending on how many jobs have been stacked previously, the tray 18 may have a tendency to "overshoot" the desired stopping location after the tray motor is stopped by the sensor 50 signal. The preferred system is designed to accommodate this overshoot, however, and position the top of the stack appropriately up against the stack holder pad 40 at an effective amount of pressure on the top sheets 24, whether the tray is overshooting significantly (due to a light-weight stack of several sheets) or whether the tray is not overshooting (due to a heavy stack consisting of hundreds of sheets). To accomplish this, each stack holder strip 30 is designed to be flexible enough to bend safely in the case of overshoot and to be resilient enough to repeatedly return to it position after the tray and stack move downward. Also, the off-setters (wings 42, 43) are designed to have enough mechanical play, so that they are not damaged when overshoot causes the output stack to "hit" against the stack holders 10 with increased force and thereby apply pressure on the off-setters.

The simplicity of the invented system allows for economical, effective, and relatively maintenance-free installation and use of the stack holder. The invented stack holder and method does not require, and preferably does not include, moving parts except for the moving tray and the inherent flexibility or mechanical play in the parts.

Preferably, the stack holders are immovable relative to the accumulator off-setters and output stack, except for flexing, and only move laterally relative to the stack when the lateral off-setters carry them in a plane generally parallel to the top sheets.

Many shapes and angles of the invented stack holder may be developed for different accumulator designs and orientations, within the general principle of a downward-forcing member which extends over the stack and preferably comes in contact with the stack necessarily only when the stack may be contacted by an object that would otherwise push/pull the stack sheets out of alignment. The preferred stack holders are connected to the accumulator wings, which allows the wings to move the stack holders horizontally when they return to their home positions. Alternatively, but less preferably, stack holders may be connected to another part of the device or its housing so that the stack holders extend over and contact the stack when the stack tray is raised, but a mechanism is then added to move the stack holders horizontally out away from the stack before the ejected sheets fall on the stack holders.

In the Description and the Claims, the forward direction means the direction of travel of paper from the output path, which is also the direction of conventional misalignment of the stack 16. The rearward direction, therefore, means the direction into the output path inside the device housing. The term "remote" means that the output storage location is located a distance from the print engine of the device for access by the user, for example, in a movable sorter connected to the side of the printer housing, or a location further from the print engine such as at the end of a long, multiple-post-processing media path.

Although this invention has been described above with reference to particular means, materials, methods, and embodiments, it is to be understood that the invention is not limited to these disclosed particulars, but extends instead to all equivalents within the scope of the following claims.

What is claimed is:

1. In a printing device having an accumulator adapted to collect one or more sheets of printed media and eject said media to an output stack in an output stack tray below the accumulator, the improvement comprising apparatus for improving output stack quality, the apparatus comprising:

a stack holder connected to the accumulator and extending generally downward toward the output stack;

a mechanism for moving the stack tray generally vertically up and down; and control logic that causes the stack tray to move up toward the accumulator, during ejection of said media to the output stack, to force the output stack against the stack holder so that the stack holder presses upon a top surface of the output stack;

wherein the stack holder comprises a frictional surface that contacts the top surface of the output stack during ejection of said media and that frictionally engages said top surface to limit movement of said top surface relative to the stack holder and accumulator.

2. The apparatus of claim 1, wherein the control logic further causes the stack tray to move down away from the stack holder, when ejection is substantially complete, so that the stack holder frictional surface does not touch said top surface of the output stack.

3. The apparatus of claim 1, further comprising a sensor adapted to sense when the stack tray has raised the output stack to a level at which it touches the stack holder.

4. The apparatus of claim 1, wherein the stack holder comprises a strip of flexible and resilient material attached at one end to the accumulator and comprising the frictional surface near an opposing end.

5. The apparatus of claim 4, wherein the accumulator comprises spaced first and second accumulator wings and the stack holder is connected at its one end to a bottom surface of said first accumulator wing.

6. The apparatus of claim 5 comprising a second stack holder attached to a bottom surface of said second accumulator wing.

7. The apparatus of claim 4, wherein the strip is generally Z-shaped with two bends between its one end and its opposing end.

8. The apparatus of claim 4, wherein the frictional surface is a pad attached to the opposing end and having a rough outer surface for contacting said top surface of the output stack.

9. In a printing device having an accumulator adapted to collect one or more sheets of printed media and eject said media to an output stack in an output stack tray below the accumulator, wherein the media lies generally horizontally on the stack tray and has an outer horizontal extent, the improvement comprising apparatus for improving output stack quality, the apparatus comprising:

a stack holder non-rotatably connected to the printing device and extending below the accumulator and over the output stack;

a mechanism for moving the stack tray generally vertically up and down;

control logic that causes the stack tray to move up toward the accumulator, during ejection of said media to the output stack, to force the output stack against the stack holder so that the stack holder presses upon a top surface of the output stack;

wherein the stack holder comprises a frictional surface that contacts the top surface of the output stack during ejection of said media and that frictionally engages said top surface to limit movement of said top surface relative to the stack holder; and a mechanism for moving the stack holder laterally out past the horizontal extent of the output stack so that the ejected media can fall down past the stack holder onto the output stack.

10. The apparatus of claim 9, wherein the control logic further causes the stack tray to move down away from the stack holder, when ejection is substantially complete, so that the stack holder frictional surface does not touch said top surface of the output stack.

11. The apparatus of claim 9, further comprising a sensor adapted to sense when the stack tray has raised the output stack to a level at which it touches the stack holder.

12. A method of improving output stack quality for a printing device adapted to eject one or more sheet of media to an output stack, the method comprising:

accumulating one or more sheets of media in an accumulator above an output stack tray holding previously-ejected sheets of media in an output stack, the accumulator comprising a laterally-moveable wing;

providing a stack holder attached to said wing, said stack holder extending generally down from the accumulator over the previously-ejected sheets;

moving the stack tray generally vertically up toward the accumulator to an extent that causes the previously-ejected sheets to abut against the stack holder and be held in place relative to the stack holder;

ejecting the accumulated media from the accumulator onto the previously-ejected sheets, while the stack holder holds the previously-ejected sheets in place; and moving the stack tray downward away from the stack holder to an extent that moves the previously-ejected media out of contact with the stack holder.

13. The method of claim 12, further comprising moving the wing horizontally to move the stack holder away from the output stack after moving the stack tray downward.

14. The method of claim 12 wherein the stack holder comprises a strip of flexible material extending downward from the wing and having a bottom surface with a frictional surface for contacting the previously-ejected sheets when the stack tray is moved upwards.

15. The method of claim 14 wherein the strip is generally Z-shaped.

16. The method of claim 12 further comprising:

providing a sensor near the stack holder to sense when the stack tray has moved upwards to a location that causes the previously-ejected sheets to abut against the stack holder; and then signaling a stack tray power source to stop moving the stack tray.

17. The method of claim 12 wherein the accumulator further comprises a second wing and the method further comprises providing a second stack holder attached to the second wing.

* * * * *